United States Patent [19]

Molin

[11] 4,410,049

[45] Oct. 18, 1983

[54] DIRECTIONAL VALVE MEANS FOR POSITIONING MACHINE UNITS

[75] Inventor: Alexis Molin, Saltsjöbaden, Sweden

[73] Assignee: Atlas Copco Aktiebolag, Nacka, Sweden

[21] Appl. No.: 259,816

[22] Filed: May 4, 1981

Related U.S. Application Data

[63] Continuation of Ser. No. 916,063, Jun. 16, 1978, abandoned.

[30] Foreign Application Priority Data

Jun. 21, 1977 [SE] Sweden ..... 7707137
Jun. 21, 1977 [SE] Sweden ..... 7707138

[51] Int. Cl.[3] ..... E21C 5/00

[52] U.S. Cl. ..... 173/2; 173/43; 414/5; 248/188.3; 248/660

[58] Field of Search ..... 173/20, 2, 42–44, 173/38; 137/625.22, 625.23, 625.3; 182/2; 414/4, 5; 248/2, 16, 23, 188.3, 654, 660; 91/419; 297/1; 33/395, 399, 400

[56] References Cited

U.S. PATENT DOCUMENTS

| | | | |
|---|---|---|---|
| 1,657,412 | 1/1928 | Schneider . | |
| 2,082,410 | 6/1937 | McCauley | 137/625.19 X |
| 2,520,266 | 8/1950 | Adams . | |
| 3,087,636 | 4/1963 | Weaver | 182/2 X |
| 3,171,437 | 3/1965 | Suechting | 137/625.23 X |
| 3,233,700 | 2/1966 | Myers | 182/2 |
| 3,254,674 | 6/1966 | Leask | 137/625.23 |
| 3,397,915 | 8/1968 | Small et al. | 91/419 X |
| 3,470,969 | 10/1969 | Arcangeli | 173/43 |
| 3,476,193 | 11/1969 | Stromnes | 173/43 |
| 3,481,409 | 12/1969 | Westerlund | 182/2 X |
| 3,556,155 | 1/1971 | McWilliams | 137/625.3 X |
| 3,590,948 | 7/1971 | Milner | 182/2 |
| 3,608,743 | 9/1971 | Mosher | 414/5 |
| 3,645,359 | 2/1972 | Raymond | 182/2 |
| 3,698,580 | 10/1972 | Carlson et al. | 414/5 |
| 3,721,304 | 3/1973 | Hanson | 173/43 X |
| 3,893,540 | 7/1975 | Beucher | 182/2 |
| 3,896,885 | 7/1975 | Dahlstrom et al. | 248/2 X |
| 4,066,135 | 1/1978 | Wallace | 173/44 |

FOREIGN PATENT DOCUMENTS

| | | | |
|---|---|---|---|
| 1083476 | of 0000 | France . | |
| 1440322 | 6/1976 | United Kingdom | 182/2 |

*Primary Examiner*—James G. Smith
*Assistant Examiner*—Robert P. Olszewski
*Attorney, Agent, or Firm*—Frishauf, Holtz, Goodman & Woodward

[57] ABSTRACT

A servo system is presented for controlling the angular attitude of machine units pivotally mounted on an outlying boom frame. Said system is applicable to rock drilling machines, breakers, loading scoops and forks, working platforms, manipulator booms, and the like. The system includes a directional control valve for governing the positioning motor of the machine unit. Under full working pressure the directional valve in itself provides automatic attitude control of the machine unit. To this end the directional valve is provided with a feedback position, in which the pressure fluid communications to the positioning motor are cut off and furthermore has a syngonous (uniangular) relationship on the one hand to the actual angle value of the machine unit with one of its valve elements and on the other to a selective set angle value with its other valve element.

12 Claims, 26 Drawing Figures

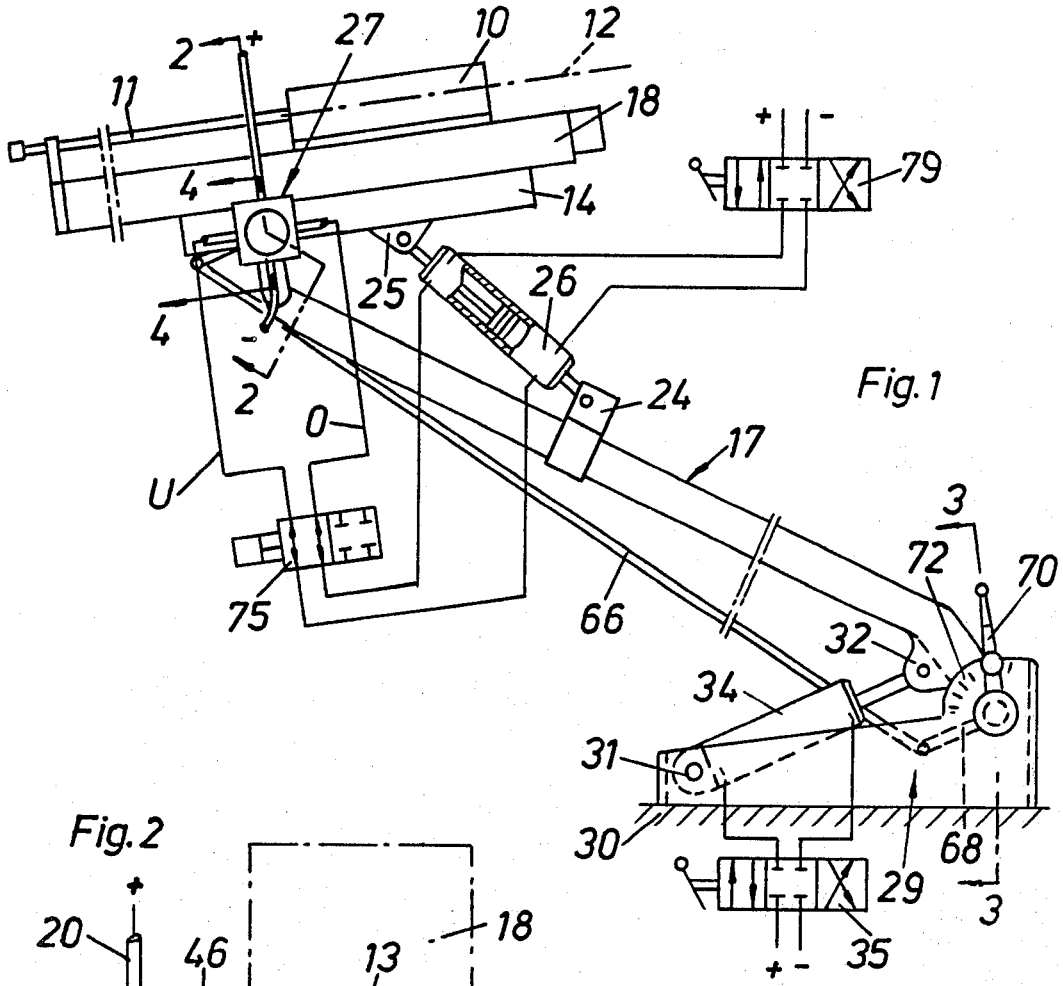
Fig. 1
Fig. 2
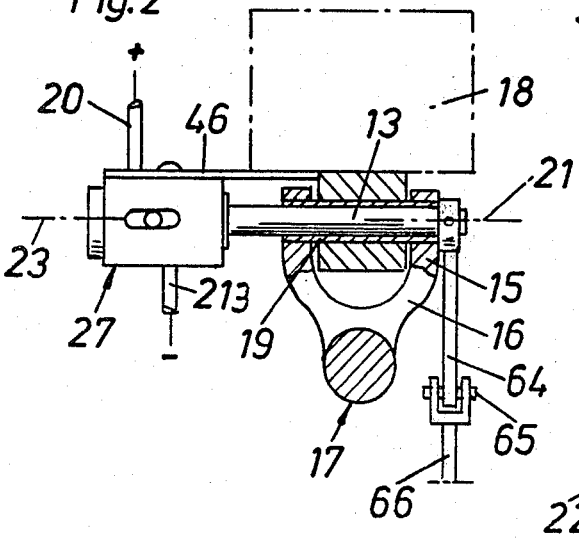
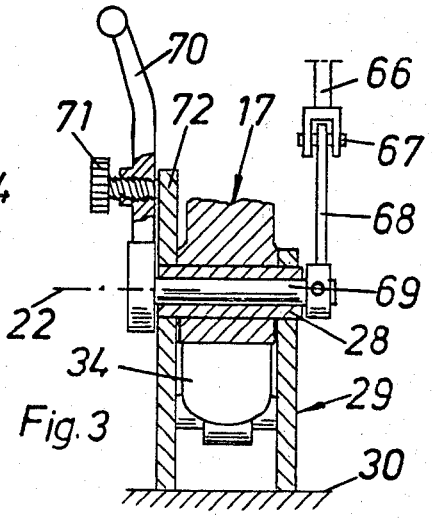
Fig. 3

Fig. 9
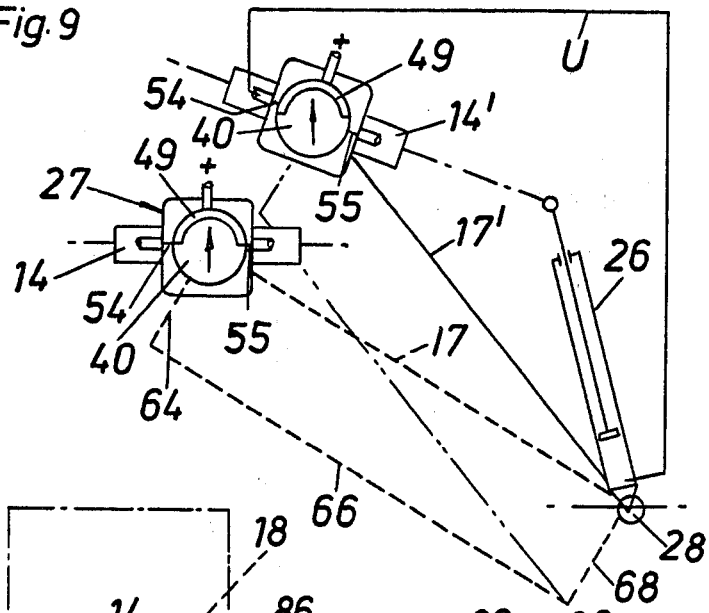
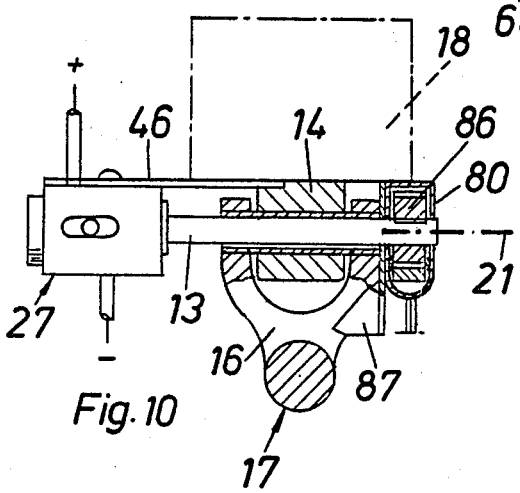
Fig. 10
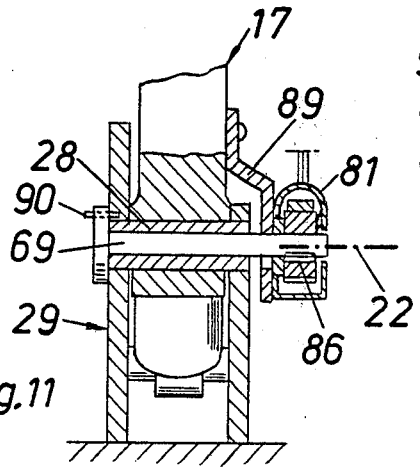
Fig. 11
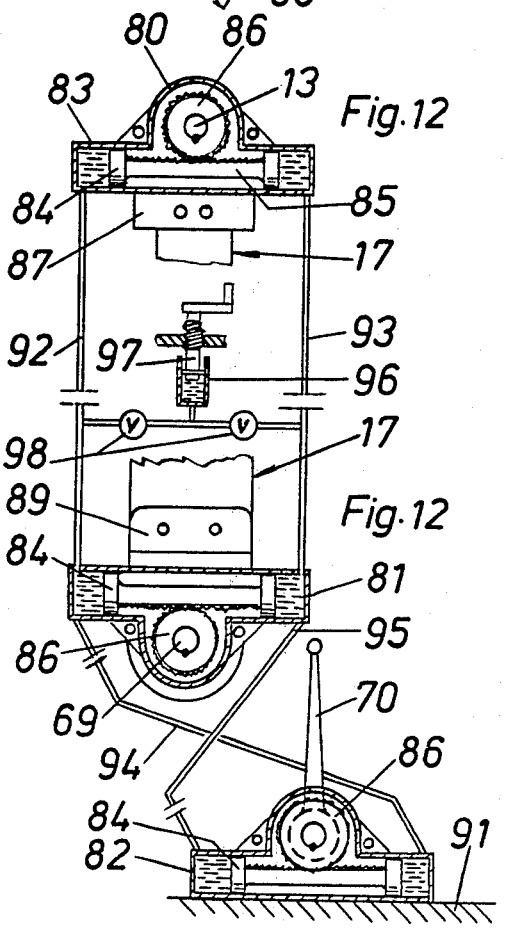
Fig. 12
Fig. 12

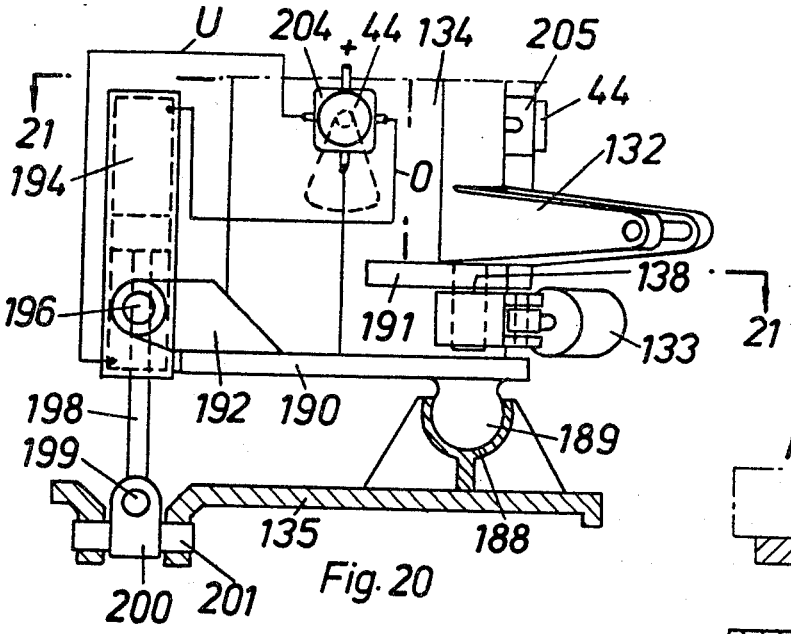
Fig. 20
Fig. 23
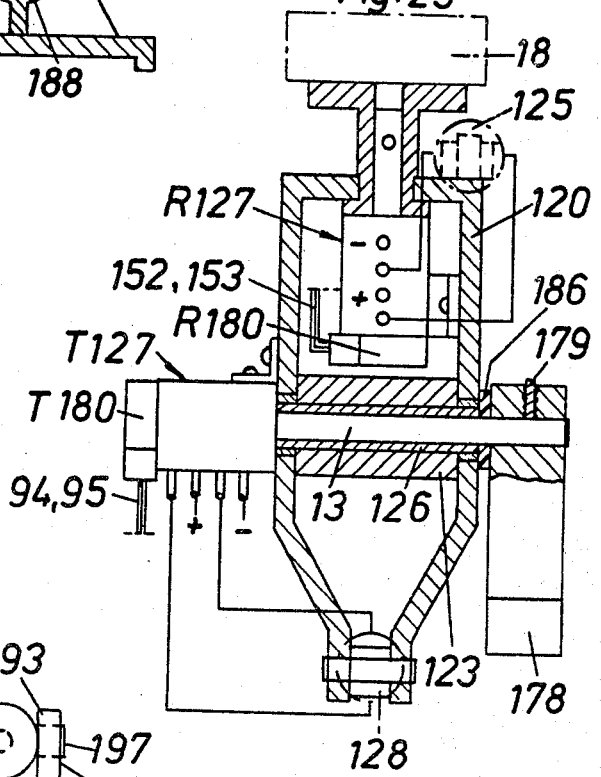
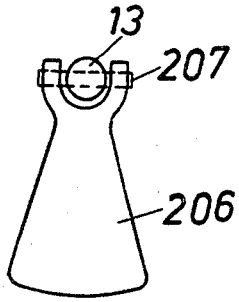
Fig. 22
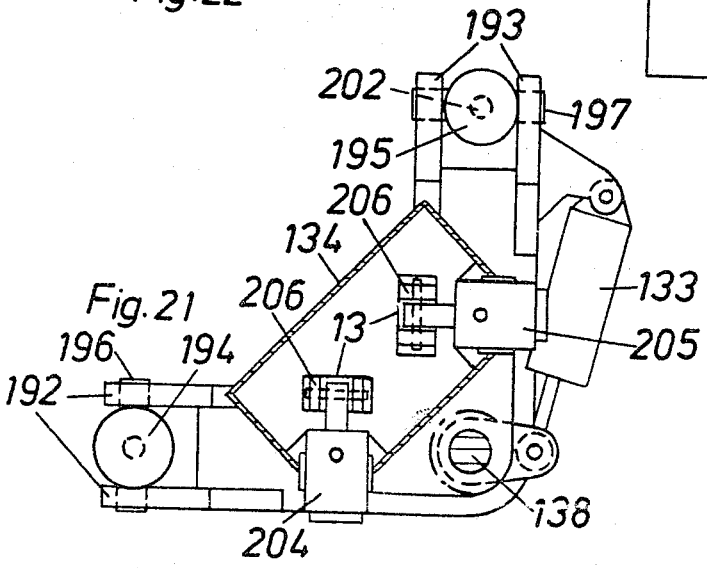
Fig. 21

DIRECTIONAL VALVE MEANS FOR POSITIONING MACHINE UNITS

This is a continuation, of application Ser. No. 916,063 filed June 16, 1978, now abandoned.

This invention relates to a directional valve means for positioning machine units by the aid of pressure fluid driven positioning motor means and a directional valve for controlling the pressure fluid supply thereto, in which a machine unit is to be positioned about a first axis relative to an outlying boom frame means which in its turn is angularly adjustable about a second axis relative to a supporting means, the directional valve being included in an angle setting servo system incorporating a control unit which system under movement of the boom frame means automatically governs the positioning motor so as to cause the machine unit to maintain its direction in the surrounding space in relation to a predetermined set angle value therefor.

Hitherto applied similar means are labour-saving as far as positioning is concerned but rely on relatively complicated usually electrically or pneumatically controlled servo appliances for producing the desired parallel directional control (see U.S. Pat. Nos. 3,481,409, 3,896,885, and 3,721,304). The required high initial outlay has resulted in failure of such appliances to attain a per se desirable more general spreading.

Directional valve systems incorporating a feed back relationship to the motor to be controlled have on the other hand been suggested previously for servo steering vehicles and for levelling grader blades (see U.S. Pat. Nos. 1,657,419, 2,520,266). The very special coordination between the controlling valve and the object to be controlled in these applications is of a character to prevent utilization of the valve type in question for more general positioning purposes such as involving remote control.

It is an object of the invention to widen the scope of application of servo controlled angular positioning and maintenance of parallel attitude to machine units pivotally mounted on outlying boom frame means. A substantially simplified control system is created, particularly suited for remote control under full working pressure of the pressure fluid utilized.

The invention can advantageously be utilized for general directioning and parallel attitude maintenance of machine units by the aid of pneumatics or hydraulics in connection with for example feeding of rock drilling machines, manipulation of breakers, working tools, working platforms, fork lifts, loading and excavator scoops, boom frames, industry robot arms, weapons, etcetera. Without in any way implying a restriction of applicability of the invention, the latter will hereinafter for the purpose of uniformity be consistently described in connection with attitude control for rock drilling machines. In this context the applicability to other similar technique will appear obvious and evident from what is being treated and will not be pointed out specifically in order to avoid trivial repetition.

BRIEF DESCRIPTION OF THE DRAWINGS

FIG. 1 is a side view of a drill boom in which the directional control valve means of the present invention have been incorporated, FIGS. 2 and 3 are enlarged sections on the lines 2—2 and 3—3 in FIG. 1, FIG. 9 is a heavily schematisized functional view of the valve parts in FIG. 5 in two separate positions, primarily relating back to FIG. 1, FIGS. 10 and 11 show a modification of the angle transmission of the respective FIGS. 2 and 3, FIG. 12 shows the angle transmission in FIGS. 10 and 11 seen on the lines 12—12 together with a section through an angle setting lever for the angle transmission.

FIG. 20 shows partly in section a side view of an automatic levelling device for supporting the drill boom of FIG. 15, FIG. 21 is a view seen partly in section of the line 21—21 in FIG. 20, FIG. 22 shows an enlarged view of a pendulum weight included in FIGS. 20, 21, FIG. 23 shows a modification of the angle setting system in FIG. 18 which modification is capable of sensing the vertical and is intended to be applied together with the setting means in FIGS. 16 or 12.

DETAILED DESCRIPTION OF PREFERRED EMBODIMENTS

Figure 4:
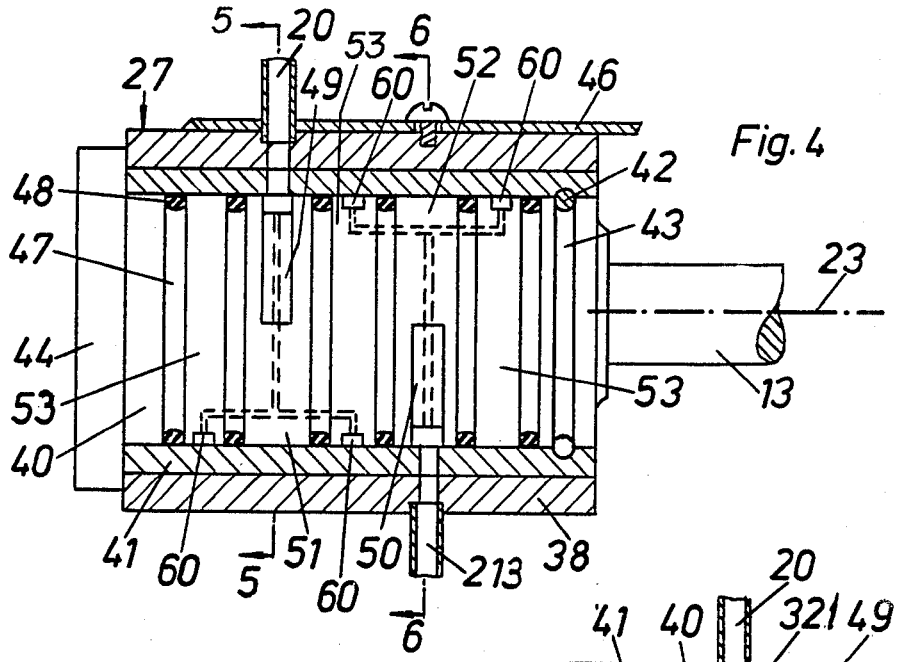
FIG. 4 is an enlarged section of the line 4—4 in FIG. 1, FIGS. 5 and 6 are sections of the lines 5—5 and 6—6 in FIG. 4.
Figure 7:
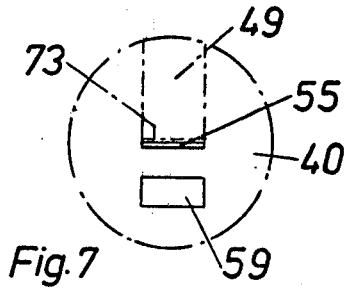
FIG. 7 is an enlarged view of the inside of the valve housing seen on the line 7—7 in FIG. 5.

FIG. 1 illustrates a feed 18 for a rock drilling machine 10 which includes conventional feeding means, not shown in detail, by means of which the machine 10 can be moved by power to and fro along the feed 18. The machine 10 carries a drill steel 11 which defines a drilling axis 12. A carrier 14 supports the feed 18 and is pivotal on a first pivot axis 21, FIG. 2, defined by a hollow axis 19 fixed between a pair of lugs 15 on a fork 16 at the upper part of the drill boom or drill frame 17. A positioning motor preferably a double acting hydraulic control cylinder 26, is pivotally coupled across the axle 19 between an attachment 24 on the boom frame 17 and a joint 25 on the carrier 14. By means of a directional valve 27 which via conduits O and U connects to respectively the upper and the lower side of the control cylinder 26, the length of the cylinder 26 can be adjusted. This sets the angle of the machine 10, its drilling axis 12 and the feed 18 around the pivot axis 21.

The boom frame 17 is pivotally journalled about the pivot axis 22 of a second hollow axle 28, FIG. 3, relative to a boom support 29 which in the embodiment shown is illustrated diagrammatically as being a frame. The boom support preferably may be adjustable in any suitable conventional way, for example as shown in U.S. patent publication 3,476,193, and may form part of a conventional drilling wagon simply designated by numeral 30 in FIG. 1. A double acting pressure fluid cylinder 34 is pivotally coupled between a joint 31 in the boom support 29 and a joint 32 on the boom frame 17. The length of the cylinder 34 is adjusted by the aid of a directional valve 35 which sets the angle of the boom frame 17 with respect to the boom support 29 around the pivot axis 22.

The directional valve 27 shown in FIGS. 2, 4 comprises a valve body formed by a slide or plug 40 which has a sealing fit and is pivotally journalled in a valve housing 41 for turning movement around the central axis 23 thereof. The valve housing 41 is formed as a lining sleeve which is connected by an adhesive to or sealingly fitted in an outer housing 38. The slide 40 is maintained axially by a cross pin 42 in the valve housing 41 which engages a ring groove 43 in the slide 40. An end flange 44 forms the outer termination of the slide 40 while its opposite end forms or is connected to a positioning axle 13 extending through the hollow axle 19, FIG. 2. A plate 46 connects the outer housing 38 to the carrier 18 with the valve axis 23 in coaxial relation to the pivot axle 19.

The slide 40 has two control lands 51, 52 and adjacent thereto and therebetween three balancing lands 53. All said lands are terminated by annular graooves 47 carrying O-rings 48 which seal against the valve housing 41. The control lands 51, 52 are provided with mutually opposed peripheral passages 49, 50, FIG. 5, 6 which for purposes of to certain extent balancing pressures preferably are disposed in mirror symmetry with respect to a common central plane 45 and extend each to a pair of opposed narrow slits 54, 55 and 56, 57. Each of said slits extends to its respective groove 58 in the outer periphery of the valve housing 41. The slits 55, 57 via the grooves 58 at one side of the outer housing 38 are both in communication with a conduit O which is connected to one end, in FIG. 1 the upper end of the control cylinder 26. At the opposite side of the outer housing 38 the respective slits 54, 56 are in a corresponding way via the grooves 58 both connected via a conduit U to the opposite, lower end of the control cylinder 26. In the two opposite directions of movement of the slide 40 the slits 54 to 57 are followed by wide secondary openings 59 which likewise are connected each to one of the grooves 58. The peripheral passage 49 is supplied with pressure fluid preferably pressure oil from a conduit 20 via a bore 32 in the valve housing 41. The peripheral passage 50 is via a bore 33 connected to a return conduit 213. The slits 54–57 may, as shown, coincide with the central plane 45. They may also be provided in pairs in mirror symmetry or grouped in other suitable way at opposite sides of said plane 45 in case one would desire to influence the angular range of the directional valve 27. The central plane 45 preferably is set parallel with the drilling axis 12 when the outer housing 38 is affixed to the carrier 14.

To ease the turning movement of the slide 40 in the valve housing 41 further pressure balancing is provided by means of branched passages 61 which lead from each peripheral passage 49, 50 to a pair of opposed peripheral balancing grooves 60 in the balancing lands 53, the intermediate of the lands 53 having provided therein two of the balancing grooves in diametrically opposed arrangement. By choosing a suitable area on the double pair of mutually connected balancing grooves 60 the pressure which acts in the opposed corresponding peripheral passage 49 and 50, respectively, can be suitably balanced.

At the other side of the boom fork 16 the positioning axle 13, FIG. 2, carries fixedly connected thereto an arm 64 which over a pivot pin 65, a link 66, and another pivot pin 67 is pivotally connected to an arm 68. The arm 68 is fixedly connected to an axle 69 which coaxially on the axis 22 passes through the hollow pivot axle 28. An angle setting lever 70 is fixedly connected to the other end of the axle 69 and is, for example by the aid of an arresting screw 71 adjustably affixable with respect to a graduated sector 72 on the boom support 29. The elements 64, 66 and 68 provide a parallelogram linkage for the boom frame 17 with the axes 21, 22 as axes of reference and consequently provide a syngonous (uniangular) transmission which creates a predetermined angular relationship between the slide 40 and the boom support 29.

Figure 8:
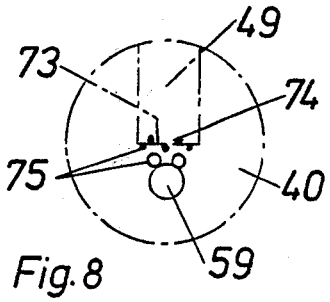
FIG. 8 shows a modification of the inside of the valve in FIG. 7.
Figure 5:
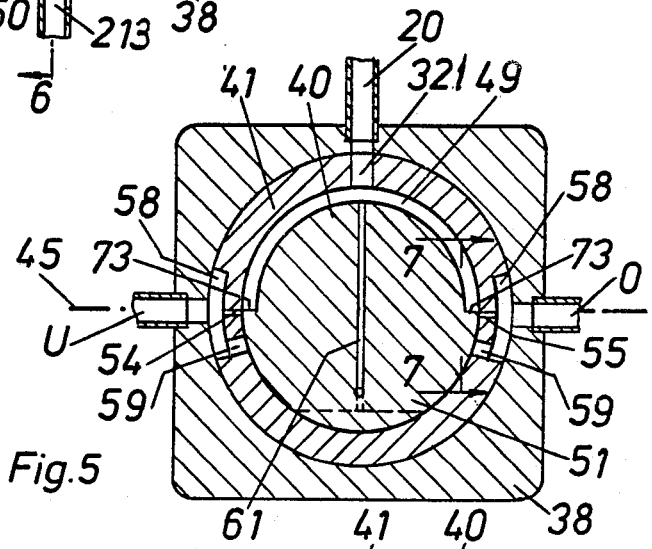
Figure 6:
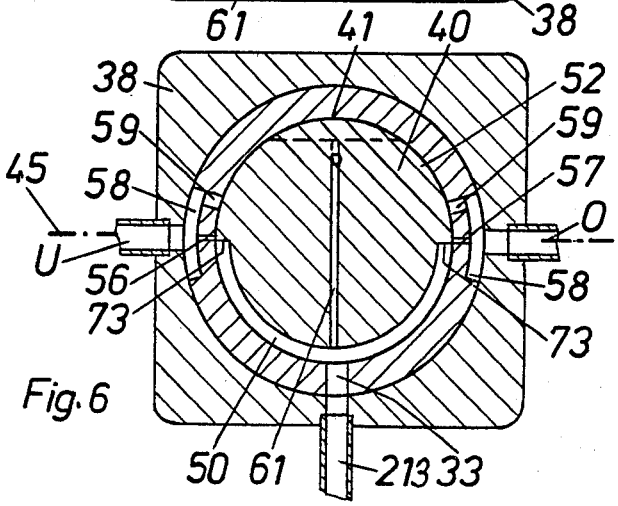

In the directional valve 27 the slide 40 occupies a feedback position in FIGS. 5, 6. The pressurized peripheral passage 49 is cut off at its opposite valve or end surfaces 73—if one disregards certain practically unavoidable leakage past said surfaces 73—with respect to the slits 54, 55 and to the conduits O and U, i.e. to the upper and the lower ends of the control cylinder 26 in FIG. 1. In equal manner the peripheral passage 50 connected to return 213 is at its surfaces 73 kept substantially closed with respect to the slits 57, 58 and passages O and U. In order to improve the sensibility for adjustment in the feedback position, a certain controlled leakage past the surfaces 73 can be chosen. Thus preferably, the leakage from passage 49 is chosen somewhat larger than the return leakage to the passage 50. This means that both passages O, U and sides of the control cylinder 26 are kept under pressure. This is attained by making the slits 54, 55 somewhat wider than the slits 56, 57, compare FIG. 13. An alternative is shown in FIG. 8 in which the valve surfaces 73 in the feedback position of the slide 40 at both sides of the peripheral groove 49 leave for example two fine bores 34 open and further bores 75 of stepwise increased number or size closed while the peripheral groove 50 in corresponding way, not shown, only leaves a single or no fine bore open at its corresponding end surfaces 73.

Turning the slide 40 in clockwise direction in FIGS. 5, 6 causes the pressurized passage 49 first via the slit 55 and then also via the secondary opening 59 to be connected to the conduit O in FIG. 5 while the valve land 51 in the same figure will keep slit 54 and thus the conduit U closed.

Simultaneously, in FIG. 6, the low pressure passage 50 first via the slit 56 and then via the secondary opening 59 is connected to the conduit U while the valve land 52 keeps slit 57 and conduit O closed with respect to the return 21. Thus the upper side of the control cylinder 26 in FIG. 1 is pressurized via O and its lower side simultaneously connected to return via U so that the control cylinder 26 is rapidly caused to be shortened by the pressure fluid primarily via the secondary openings 59 and may thereafter be adjusted with greater accuracy via the narrow slits 55, 56. During turning in counter-clockwise direction in FIGS. 5, 6 the directional valve 27 in a similar manner via the slits 54, 57 and their secondary openings 59 causes extension of the control cylinder 26. Since valve housing 41 and its outer housing 38 via the plate 46 rotates concurrently with the carrier 18 and thus sense the actual angle value of the drilling axis 12, a change in length of the control cylinder 26 also cause a turning of the valve housing 41. During clockwise rotation, when the control cylinder 26 is shortened, the feed 18 in FIG. 1 likewise is turned in clockwise direction causing the valve housing 41 to turn in the same direction until chasing the slide 40 until the feedback position with respect to the central plane 45 is re-established in the new angular position of the slide 40. The directional valve 27 thus works under full pressure of the working fluid as a servo control unit wherein a set angle value is given to the slide 40 whereafter the control cylinder 26 will turn the valve housing 41 representing the actual angle of the machine unit or drill 10 to re-establish feedback thus again substantially closing or throttling the directional valve 27 when the machine unit has taken the new predetermined set angle value prescribed by the slide 40.

Let it be supposed that the directional valve 27 in the lower position of FIG. 9 takes feedback position and the carrier 14 of the machine unit is disposed horizontally. When the boom frame 17 by the power cylinder 34, FIG. 1 is turned around the pivot axle 28, i.e. the axis 22 from the position 17 in FIG. 9 to an elevated position 17[1], the control cylinder 26, in case it would have remained inactivated, would keep the housing of the directional valve 27 in an unaltered position relative to the boom frame 17 with the carrier in an imagined upturned position 14[1].

The angle transmission provided by the parallelogram linkage 17, 64, 66, 68 during elevation of the boom frame 17 evidently causes syngonous (uniangular) parallel displacement of the slide 40. In a tendency to move towards the position 14[1] the pressurized peripheral passage 49 is connected to the slit 54 and the conduit U to the lower end of the control cylinder 26 so that the latter is extended and maintains the directional valve 27 and the carrier 14 in feedback position, i.e. horizontally. Since the slide 40 in all angular positions of the boom 17 maintains its given and parallel angular position in the surrounding space, the directional valve 27 due to its servo functions and feedback coupling via the control cylinder 26 will also during turning automatically maintain the carrier 14 in syngonous parallel positions so as to bring the sensed actual angle value to correspond with the set angle value determined by the slide 40.

The practically attainable angular accuracy of the directional valve 27 can be increased by an increase of the diameter of the valve 27 whereby the narrow slits 54–57 or the fine bores 74 with increasing diameter will cover a decreasing number or fraction of angular minutes thereof.

By loosening the screw 71 it is possible to select freely the angle of adjustment of the slide 40 on the axes 21 and 23 thereof by the aid of the angle setting lever 70 and the parallelogram linkage 64, 66, 68. The angle setting lever 70 is preferably positioned in a predetermined for example right angular relationship to the central plane 45 of the directional valve 27 i.e. with respect to the carrier 14. As a result, the angle setting levers 70 during actual adjustment thus will provide a pattern element for prescribing the angular setting of the carrier 14, and by reading the graduated sector 75 it will be possible to directly adjust the desired angle of the carrier 14 and its machine unit in the surrounding space after the supporting device 30 preferably first having been placed level.

If it is desired to adjust the carrier 14 independently of the angle setting lever 70 in alternative special working directions while keeping "in memory" the preselected desired direction for maintaining the carrier 14 in parallel relation, the passages O and U can be closed off by a preferably remotely controlled valve 75[1], FIG. 1, from connection with the control cylinder 26. The latter is then directly actuated via a separate directional valve 79. After terminated work in the irregular direction set by the directional valve 79, the cut-off valve 75 is re-opened at which instant the directional valve 27 automatically will revert to the original feedback position so that work can be resumed in the normal direction dictated by the angle setting lever 70.

Figure 24:
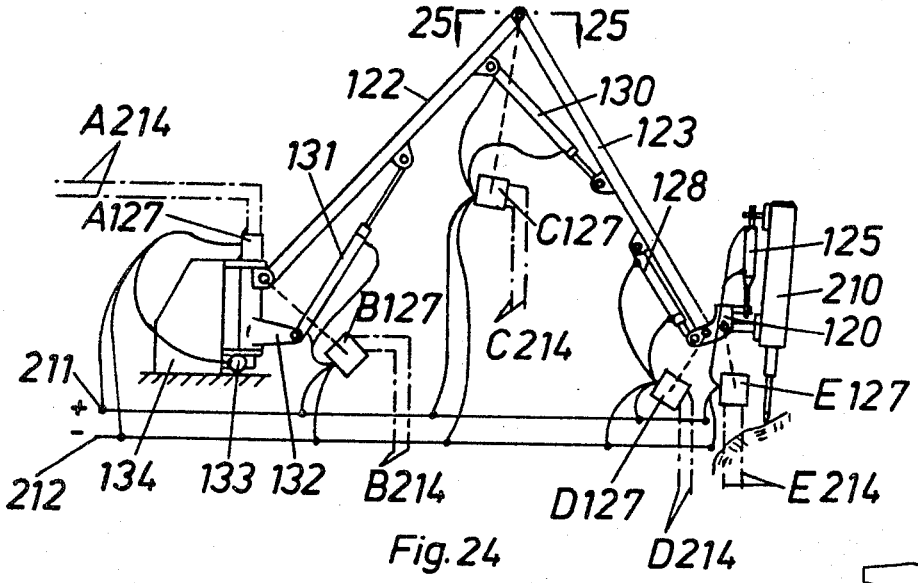
FIG. 24 shows a diagrammatic illustration of the valve functioning principle in a modified control for concurrent positioning both of a boom frame of the type shown in FIG. 15 and of the machine unit, for example a working tool, carried thereby.

A disposition of the directional valve 27 with its turning axis 23 coaxial with the pivot axis 21 of machine unit normally is to be preferred due to on the one hand the pressure fluid conduits from the directional valve 27 in such case having their shortest distance to the control cylinder 26 and on the other a multitude of similar directional valves 27 for controlling a whole assembly of control cylinders in hydraulically actuated machinery can simply be connected to a single pair of main pressure manifold and a return manifold respectively, compare FIG. 24. It is, however, also possible, in case of need to provide the directional valve 27 in another location of the machinery for example on the boom support 29, which is described in detail in the concurrent Swedish patent application No. 7707139-7, (corresponding to U.S. patent application Ser. No. 916,492, filed June 19, 1978, now abandoned in favor of a Continuation Application Ser. No. 304,984, filed Sept. 23, 1981) FIG. 9. In such case the actual angle value of the carrier 14 is transmitted via a suitable angle transmission for example by the aid of parallelogram linkage, chains on chain wheels, steel wires on sheaves, and torque transmitting flexible steel cables, said transmission incorporating the axes 21, 22 and the turning axis of the valve 23 as reference axes. In the displaced directional valve 27 the angle setting lever 70 then instead can be connectd, in case of need, via a still further angle transmission, to the valve housing 41 for the command of the set angle value.

It is furthermore obvious from FIG. 4 that the actual angle value via the connecting plate 46 alternatively can be transmitted to the slide 40 by the plate 46 being connected for example to the flange 44. In such an embodiment the valve housing 41 will be coupled directly to the positioning axle 13 which then is made separate from the slide 40. In this case the set angle value is transmitted from the angle setting lever 70 directly to the valve housing 41 for turning the latter around the valve axis 23 together with the outer housing 38 and the conduits 20, 213, O and U relative to the carrier 14.

In the embodiment shown in FIGS. 10–12 the parallelogram linkage angle transmission has been replaced by a parallel angle transmission by the aid of mutually hydraulically bound power cylinder devices 80, 81, 82. In the examples shown, each of these consists of a double acting cylinder 83 in the opposed cylinder chambers of which a double piston 84 has a sealing slidable fit.

The double piston 84 has an intermediate finely toothed rack 85 which with precision minimum clearance engages a toothed wheel 86. The cylinder device 80 is screwed to a bracket 87 which is affixed to one side of the fork 16 on the boom frame 17. The toothed wheel 86 is affixed to the positioning axle 13 coaxially on the axis 21. In similar way the cylinder device 81 is screwed to a bracket 89 at the inner end of the boom frame 17 with the toothed wheel 86 of the cylinder device 81 affixed to the axle 69 coaxially on the axis 22. The axle 69 in its turn is affixed to the boom support 29 by a pin 90. The cylinder device 82 is placed on a suitable control panel 91 and the angle setting lever 70 is fixedly coupled to its tootehd wheel 86 and may similarly to FIG. 3 be locked by an arresting screw in the desired angular position relative to the cylinder device 82.

The opposite cylinder chambers of the cylinder devices 80, 81 are inter-connected in pairs in parallel mutual relation by means of conduits 92, 93. In similar manner the opposed cylinder chambers of the cylinder devices 81, 82 are inter-connected crosswise in pairs by means of conduits 94, 95. All cylinder chambers of the three cylinder devices 80–82 are equal in size. Thus an angular turning of the angle setting lever 70 is transmitted via the cylinder chambers of its double piston 84, the conduits 94, 95, the cylinder chambers of the cylinder device 81, the conduits 92, 93 and the cylinder chambers in the cylinder device 80 to the double piston 85 thereof producing angularly reproduced syngonous turning of the toothed wheel 86 which is connected to the positioning axle 13. When the boom frame 17 is pivoted the cylinder device 81 will turn in unison therewith relative to its toothed wheel 86, which latter remains arrested via the axle 69 to the boom support 29 causing the double piston 84 to be displaced within the cylinder device 81 thereof in response to angular movement of the boom frame 17. Since the angle setting lever 70 is kept locked in its adjusted position, such doble piston movement will be transmitted via the conduits 92, 93 to the double piston 84 in the cylinder device 80 and will produce a syngonous opposed angular movement of the positioning axle 13 and thus parallel angular displacement of the slide 40 connected thereto. For correcting the mutual adjustment of the double piston 84 there is provided an oil filled ackumulator cylinder 96 which is actuatable by an adjustable piston 97 and via normally closed valves 98 can be connected with one or both of the conduits 92, 93 whereby the angle setting lever can freely be positioned with respect to an angularly graduated scale, not shown, to provide a direct counter-pattern for the angular position of the carrier 14 and the machine unit thereon. The described cylinder chambers and the conduits of the syngonous transmission work on low maneuvering oil pressure in analogy with conventional brake cylinders and their conduits.

Alternatively instead of syngonous parallel displacement by parallelogram linkage or hydraulic means, one of the control elements of the directional valve 27 can also be adjusted by a steel cable transmission as shown in the concurrent Swedish patent application No. 7707139-7 (corresponding to U.S. application Ser. No. 304,984, filed Sept. 23, 1981), FIGS. 16–21 incorporating torque transmitting flexible and angularly adjustable cable means extended to a remotely positioned fixed support.

Figure 13:
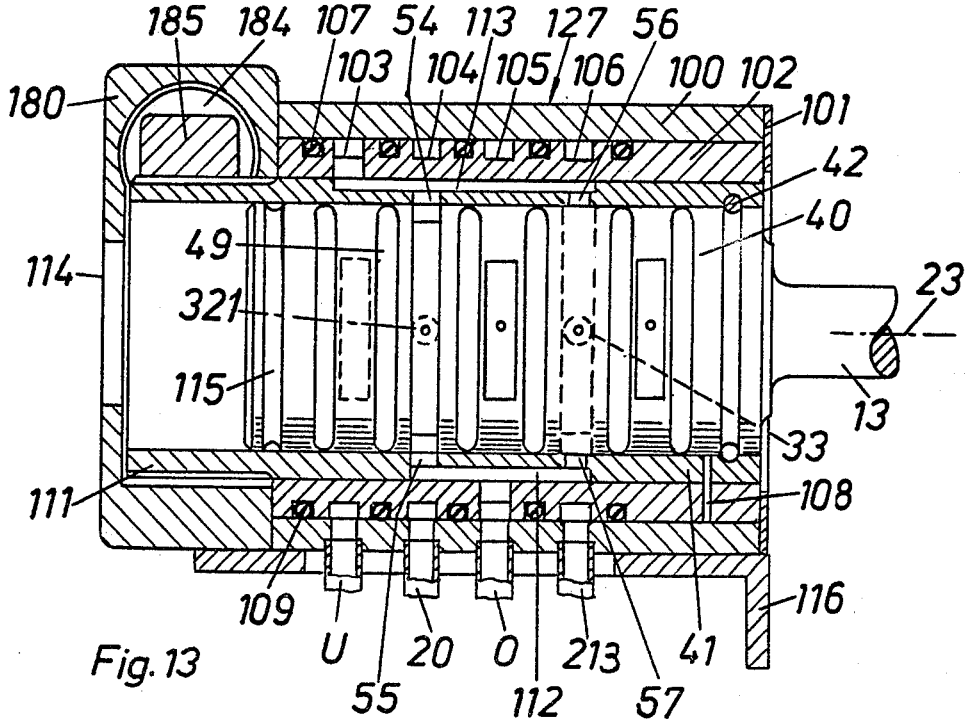
FIG. 13 shows a modification of the valve in FIG. 4.

In the modification shown in FIG. 13 the directional valve 27 comprises an adjustment sleeve 102 which is sealingly affixed for example by an adhesive around and to the valve housing 41 under mutual non-rotative affixing by means of a pin 108. The adjusting sleeve 102 is provided with circumferential peripheral collector grooves 103–106 and is rotatably journalled with a sealing fit in an outer housing or bearing 100. A cylinder device 180 analogous with the devices 80–82 described in connection with FIG. 12, is fixed to one end of the bearing 100. Its double piston 184 engages with the toothed rack 185 thereof a toothed annulus 111 at one end of the valve housing 41. A washer 101 is fixed to the other end of the bearing 100 for keeping the adjustment sleeve 102 rotatably in place adjacent the cylinder device 180. The throttling slits 55, 57 of the valve housing 41 open into a common groove 112 in the valve housing 41 which is connected to the collector groove 105. The throttling slits 54, 56 are in similar way connected to a common groove 113 and to the collector groove 103. The fluid supply bore 321 (shown by dotted lines) in the valve housing 41 is connected to the collector groove 104. The return bore 33 is connected to the collector groove 106. In FIG. 13 the throttling slits 56, 57 to the return 33 are chosen narrower than the throttling slits 54, 55 from the supply 32. During leakage through the valve both grooves 112, 113 thus may be set under pressure for increasing control readiness for the subordinated positioning motor or pressure cylinder. The control conduits U and O are connected to the bearing 100 to communicate with the respective collector grooves 103, 105. The supply conduit 20 for pressure fluid and the return conduit 213 are connected to the bearing 100 and the collector grooves 104 and 106, respectively.

The collector grooves 103–106 make possible by means of the cylinder device 180 convenient remote control of the angle value for the valve housing 41 in any arbitrary angular position relative to the fixed mounting of the outer bearing 100 and its pressure fluid conduits U, O, 20, 213. The assembling versatility is increased by the slide 40 being is reversibly journalled in the valve housing 41 so as to alternatively project with the positioning axis 13 thereof through an end bore 114 of the cylinder device 180. In the reversed position the cross pin 42 allows rotatable axial fixation of the slide 40 by cooperating with an opposed end groove 115 of the slide 40. The positioning axle 13 as an alternative may evidently also be affixed to the valve housing 41 in which case the toothed annulus 111 is omitted and a toothed wheel is instead arranged on the slide 40 for cooperation with the toothed rack 185 of the double piston 184. A bracket 116 of suitable design is provided for carrying the bearing 100 for convenient fixation to the machine unit which is to be angularly controlled.

Figure 19:
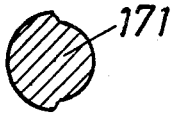
FIG. 19 shows an enlarged cam axle section pertaining to FIG. 14.
Figure 14:
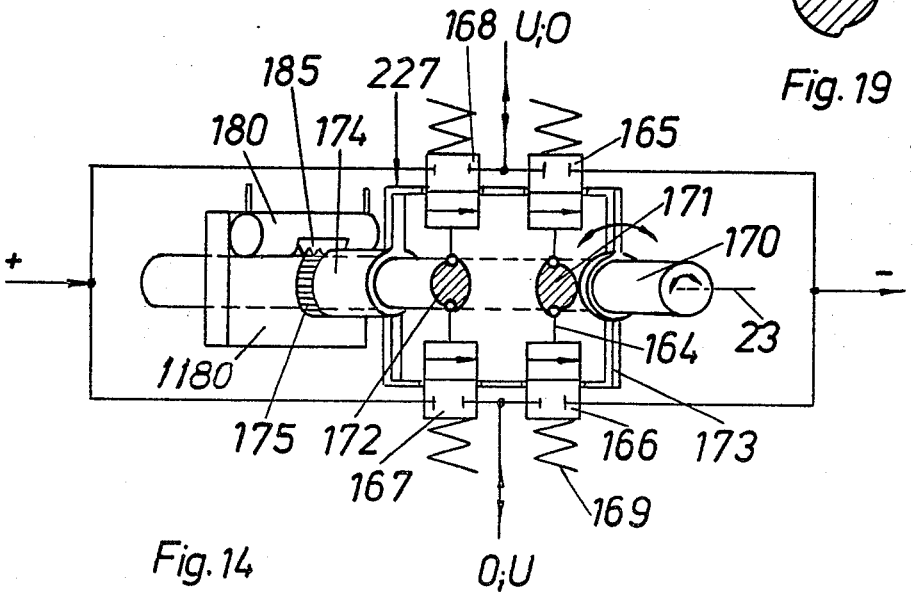
FIG. 14 is a schematic view in principle of a modified directional valve according to the invention and comprising seat or slide valve components.

In the modified directional valve 227 shown diagrammatically by the aid of valve symbols in FIGS. 14, 19, the previous end surfaces 73 on the lands 51, 52 of the valve body or slide 40 and the cooperating slits 54–57 or throttling bores 74, 75 in the valve housing 41 are replaced by four conventional seat or slide valves 165–168 in which the valve body or slide may be opened by a cam follower 164 against the action of a closing spring 169. A cam axle 170 is journalled on a carrier 1180 and defines the geometrical turning axis 23 of the directional valve 227 and has two cams 171, 172 arranged thereon preferably in mutual mirror symmetry with which the cam followers 164 of the valve bodies 165–168 cooperate. The valve housings, not shown other than by the valve symbols, of the four valves are in practice affixed to a frame 173 which is rotatably journalled about the cam axle 170. The frame 173 is rearwardly terminated by a positioning sleeve 174 which at the outer end thereof forms a toothed annulus 175. Said annulus engages a cylinder device 180 on the carrier 1180 of the type described in connection with FIGS. 13 and 12, in which the toothed rack 85 forms the waist portion of the double piston 184 and engages the toothed annulus 175.

During control the carrier 1180 is affixed in angularly fixed relationship to the one angle defining part in the servo controlled system while the cam shaft 170 is affixed to the other. By means of the cylinder device 180 the positioning sleeve 174 can be given an input set angle in clockwise or counter-clockwise direction. At the least change in angle from the feedback position illustrated in FIG. 14, in which the cam followers 164 all rest in "valve closed" position on the smaller diameter of the cams 171, 172 in close touch with the transitional cam surfaces to the larger diameter thereof, the cam followers 164 in two of the valves will ride up on said larger diameter whereas the two remaining cam followers 164 will stay on the smaller diameter. As seen from FIG. 14, when turning of the cam axle 170 in clockwise direction, the valves 165 and 167 will open while 168 and 169 will remain closed. This situation evidently causes a pressure fluid flow from the "plus" sign downwardly via valve 167 and the conduits O; U to the selected end of the subpositioned control motor, not shown, while the other end thereof via the passages U; O, respectively, at the top of the figure will be connected to return and the "minus" sign via the valve 165. During turning of the cam axle 170 in opposite counter-clockwise direction the control will be reversed by the valves 168, 166 opening and the valves 167, 165 remaining closed. Obviously the four standard valves 165–169 may be replaced by two or even into one single valve of specialized design actuated respectively by two or one single rotatable cam. Then the feedback-position will be defined as an intermediate position on slanting cam surface which connects the smaller diameter of the cam to the larger one thereof.

The positioning motors applicable with the invention may alternatively be other preferably reversible pressure fluid motors suitable for angular positioning for example linear actuators with mating screws or rotary motors of piston or vane type.

Figure 15:
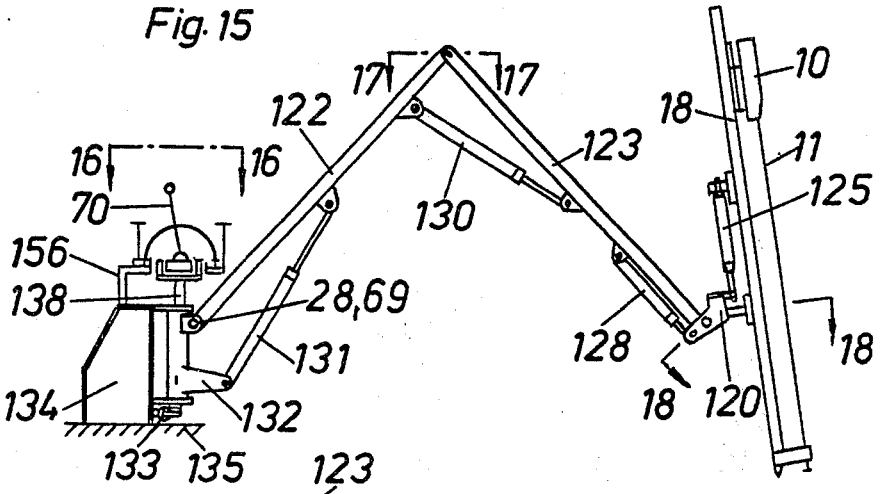
FIG. 15 shows the side view of an articulated boom frame incorporating the invention.
Figure 17:
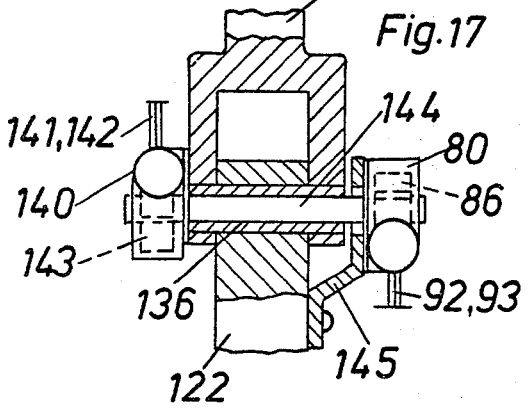
FIGS. 17 and 18 are sections of the lines 17—17 and 18—18 in FIG. 15.
Figure 18:
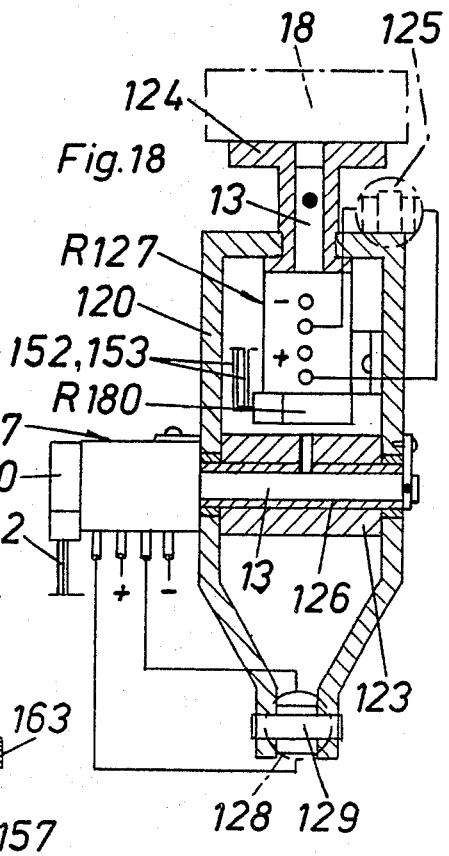

In the modification shown in FIG. 15 the machine unit such as the feed 18 of a rock drilling machine 10 is carried by a boom head 120 at the outer end of the boom portions 122 and 123 which form an articulated boom. On the boom head 120 is pivotally journalled a bracket 124, FIG. 18, which carries the feed 18 and is angularly adjustable by means of a turning cylinder 125 extending between supporting joints on the bracket 120 and the feed 18. The boom head 120 is pivotable on a hollow axle 126 fixed to the outer end of the boom part 123. The boom head 120 is pivoted by means of a tipping cylinder 128 extending between a joint on the boom part 123 and a pivot 129 on the boom head 120. A power cylinder 130 extends between support joints on the boom parts 122 and 123 for angular mutual adjustment therebetween. The boom part 122 is similarly to the boom 17 shown in FIG. 11 pivotally journalled on a hollow pivot 28 on a boom support 132, to which latter the power cylinder 131 is attached pivotally and connected to a support joint at the intermediate portion of the boom part 122 so that the latter can be pivoted on the axle 28. A turning cylinder 133 is pivoted at a support joint on a stand 134 which forms part of a conventional drilling wagon 135, not shown in detail. The cylinder 133 extends to a crank affixed to the vertical axle 138 of the boom support 132 by means of which the said support is mounted swingably on the stand 134. By the turning cylinder 133 the articulated boom 122, 123 can be pivoted in horizontal planes.

The directional valve designated T 127 is designed in accordance with FIG. 13 and its bearing housing is non-rotatably affixed to the boom head 123 in coaxial relation to and via the axle 126 with the positioning axle 13 thereof projecting into and rotatably through the hollow axle 126 and affixed to the boom part 120. The directional valve T 127 is hydraulicall coupled for controlling the opposed cylinder chambers of the tipping cylinder 128 with feedback provided as a result of the angular sensing followed by the connections of the directional valve T 127 to the boom head 120 and boom part 123, respectively. The cylinder device T 180 of the directional valve T 127 is controlled by hydraulic low pressure conduits 141, 142 connected to an analogous cylinder device 140, FIG. 17, which is non-rotatably affixed to the inner end of the boom part 123 with its toothed wheel 143 non-rotatably affixed to an axle 144 which extends freely rotatably through the hollow axle 136 between the boom parts 122, 123. At its opposite end the axle 144 is connected to a control circuit designed in analogy with what is shown in FIG. 12, the cylinder device 80 in this case being non-rotatably connected to the boom part 122 via a bracket 145 while its toothed wheel 86 is non-rotatably coupled to the axle 144. The cylinder device 81, which according to the scheme in FIG. 12 via low pressure conduits 92, 93 is inter-coupled with the cylinder device 80, is designed in analogy with what is shown in FIG. 11 and with reference to that figure is non-rotatably affixed to the inner end of the boom part 122 by a bracket 89 with the pertaining toothed wheel 86 non-rotatably affixed to the boom support 132 via a fixed positioning axle 69 projecting through the hollow axle 28 of the boom part 122 at the boom support 132.

The vertical axle 138 of the boom support 132 carries a horizontal plate 146 on which a journal 147 pivotally supports a trunnion 148 connected to one end of the cylinder device 82 corresponding to the scheme in FIG. 12. The other end of the cylinder device 82 is via a trunnion 137 non-rotatably connected to a toothed wheel 151 of an analogous cylinder device 150. On the plate 146 the turning axis defined by the trunnions 148, 137 of the cylinder device 82 coincides with the plane of swing of the articulated boom 122, 123.

Figure 16:
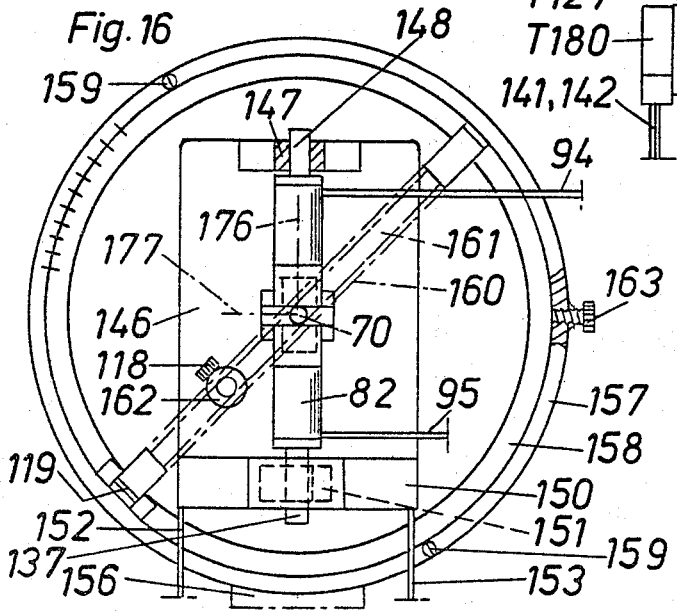
FIG. 16 is a schematic top view of the boom supporting in FIG. 15 seen in the direction of the arrows 16—16.

A directional valve R 127 designed in analogy with T 127 is affixed by its bearing housing non-rotatably to the inside of the boom head 120 in coaxial relation to the bracket 124 which provides a support for the feed 18. The positioning axle 3 of the directional valve R 127 is non-rotatably affixed within a cavity in the bracket 124. The directional valve R 127 is coupled for hydraulic control to the opposed cylinder chambers of the turning cylinder 125 under feedback via the angle sensing provided due to the fixation of the valve R 127 to the bracket 124 and the boom head 120. The cylinder device R 180 of the directional valve R 127 is coupled for hydraulic control via low pressure hydraulic conduits 152, 153 to a toothed wheel 151 of an analogous cylinder device 150, FIG. 16, which is non-rotatably coupled to the cylinder device 82. The cylinder devices 82, 150 and T 180, R 180 are adjusted mutually so that the angle setting lever 70 will provide a model pattern prescribed for the angular direction of the feed 18, i.e. will be parallel therewith both in respect of its tipping adjustment and its turning. In the position of FIG. 16 in which the angle setting lever 70 is perpendicular to the plate 146, the hydraulic low pressure control connection via the conduits 94, 95, 92, 93 (also compare FIG. 12) the coupling via the axle 144 FIG. 17 and the conduits 141, 142 provide such a setting of the directional valve T 127 and of the tipping cylinder 128 that the feed 18 is tipped to vertical position. Simultaneously, the cylinder device 150 and the hydraulic low pressure conduits 152, 153 via the directional valve R 127 and the turning cylinder 125 provide turning of the feed 18 likewise to vertical position. When the angle setting lever 70 is turned upwardly or downwardly when viewed in FIG. 16 the cylinder device 82 via the directional valve T 127 and the tipping cylinder 128 will by the feed 18 provide an exact duplication of the angular movement of the angle setting lever 70. In a corresponding way the cylinder device 150 via the directional valve R 127 will during turning of the angle setting lever 70 to the right or to the left when viewed in FIG. 60 provide an exact duplication by the feed 18 of the turning position of the angle setting lever 70.

On the stand 134 is affixed a sight table 156 which carries an outer bearing ring 157 with an inner clamp ring 158 both carried rotatably and being provided with cooperating angle graduations. The bearing ring 157 is provided with a pair of diametrically arranged sight pins 159 while the clamp ring 158 carries in swinging relation to the pin 119 a sector-shaped bow 160 which has an elongated central adjusting slot 161 in which the angle setting lever 70 is to be inserted. A bearing ring 162 is slidably journalled along the bow 160 and is by means of a set screw 118 affixable to the bow in the desired sector angle position. By turning the clamp ring 158, swinging of the bow 160 and moving the bearing ring 162 along the bow, the bearing ring 162 can be brought down around the angle setting lever 70 to act as a guide bearing therefor in the predetermined position which has been selected for the angle setting lever. A set screw 163 makes possible fixation between the rings 157, 158.

With the drill wagon 135 in place for drilling and disposed in substantially horizontal position as far as the support 135 for the stand 134 being concerned, positioning of the feed 18 may be performed. Firstly, the bearing ring 157 is set so that the sight pins 159 point towards a predetermined sighting point in the surrounding terrain and is thereafter affixed to the sight table 156. Upon having adjusted the desired titting and turning angles for the feed 18 by the aid of the angle setting lever 70, the movement of which always is closely reproduced by the feed 18, the clamp ring 158 is turned so that its adjusting slot coincides with the direction of the angle setting lever 70 in the horizontal projection thereof, and thereafter the bow 160 is pivoted down onto the angle setting lever 70 simultaneously with the bearing ring 162 being in slipped thereonto and affixed to the bow 160 by the set screw 118. Hereby the angle setting lever 70 is affixed freely turnably within the bearing ring 162 in the desired angular setting for the feed 18. By means of the set screw 163 the clamp ring 158 is locked to the bearing ring 157. For drilling in the selected position of the drilling wagon 135 of the preferably premarked holes which lie within reach of the articulated boom 122, 123 said drilling positions will be found by adjustment of the power cylinders 130, 131 and of the turning cylinder 133. Since the angle setting lever 70 is locked in its direction and the feed 18 of the rock drill is forced to reproduce said direction there is created during the efforts to find the correct drilling positions, an automatic parallel displacement of the feed 18 until the desired point for starting drilling has been reached. When during such adjustment the boom support 132 and the plate 146 are turned sidewise by the turning cylinder 133, the angle setting lever 70 will be forced to turn freely within the bearing ring 62 while maintaining its given angular attitude in the surrounding space relative to the sight ring and consequently actuates the cylinder devices 82, 150 so that parallel displacement of the feed 18 is constantly maintained. When all the holes in the first set-up have been drilled, the drilling wagon 135 is moved to the next working position. Here the bearing ring 157 is coupled free with respect to the sight table 156 and is trained by the sight pins 159 again in the previously defined bearing. Since the desired deviation in bearing between the rings 157, 153 is maintained fixed by the set-screw 163, the angle setting levers 70 will automatically regain its previous angular position as soon as the correct bearing direction has been found. In this connection the feed 18 again automatically will reproduce the corrected position of the angle setting lever 70 so that in the new set-up for drilling a series of holes will be drilled in full parallelism with the holes in the previous set-up.

In case of need the plate 164 can be journalled on an axle parallel with the vertical axle 138 together with pertaining sighting means arranged therearound on a maneuvering panel separate from the boom support 132. In this case the parallel axle by means of a suitable angle transmission, for example a steel cable transmission, must be coupled for syngonous movement with respect to the vertical axle 138.

In drill booms in which the boom similarly to the embodiment shown in FIG. 15 during adjustment remains in or close to a vertical plane and is adapted for adjustment of the feed in two mutually perpendicular planes, the mechanical angle transmission via the joints of the drill boom can be simplified in that the tipping angle and in case of need even the turning in planes parallel to the tipping axis can be set with the vertical line as reference value. This is illustrated in more detail in FIG. 23. A pendulum 178 is mounted on the positioning axle 13 of the directional valve T 127. The positioning axle 13 projects freely rotatably through the hollow axle 126, the pendulum 178 being non-rotatably affixed to the outer end of the positioning axle 13 by a screw 179. A vibration damping frictional washer may be interposed on the positioning axle 13 between the pendulum 178 and the boom head 120. The slide 40 of the directional valve T 127, FIG. 13, will thus without regard to the angular position of the articulated boom 122, 123 be maintained by the pendulum 178 in parallel relation with respect to the vertical line. Starting from said angular position, the desired set angle value is adjusted by means of the valve housing 41 in its bearing 100, FIG. 13, in relation to the vertical line. This adjustment is performed by the cylinder device T 180 which is connected directly to the control conduits 94, 95 from the cylinder device 82 on the plate 146 in FIG. 16. When the angle setting lever 70 is turned on its axis 177, a corresponding turning of the cylinder device 180 with respect to the vertical line will take place by which the boom head 120 together with the feed 18 thereon can be adjusted as desired in respect of the tipping angle. Since the boom 122, 123 and the boom head 120 are supposed to stand in vertical position, the directional valve R 127 for correct angular adjustment of the feed 18 can similarly to FIG. 18 be affixed to the boom head 120 and be adjusted directly via the connecting conduits 152, 153 and the cylinder device R 180 by means of the controlling cylinder device 150, FIG. 16, as a result of the angle setting lever 70 being turned around its second turning axis 176. Direct pendulum control of the directional valve R 127 is thus made unnecessary.

Evidently the pendulum applied to the directional valve type of FIG. 13 alternatively be affixed to the valve housing 41 in which case the cylinder device 180 with the toothed rack 185 thereof instead will have to cooperate with an affixed toothed wheel on the positioning axle 13 at the opposite end of the valve. It may be observed that the directional valve T 127 with the pendulum 178 need not be arranged in coaxial relation to the axle 126 but can instead be attached to any arbitrary position on the vertical plate portions of the boom head 120. In order to leave room for the pendulum 178 the fixation can be performed with the whole directional valve T 127 or only the slide 40 thereof turned in opposite direction with respect to the position shown in FIG. 13, in which latter case with the pendulum 178 adjacent to the cylinder device P180, a supporting roller bearing for the positioning axle 13 may then suitably be provided within the toothed annulus 111 for centering the projecting part of the positioning axle 13.

An alternative adjustment by the aid of a pendulum valve is described in the concurrent Swedish patent application No. 7707139-7 (corresponding to U.S. application Ser. No. 304,984, filed Sept. 23, 1981), FIGS. 18–21.

For assuring wholly automatically correct vertical positioning of the drill boom 122, 123 without regard to the inclination of the drill wagon chassis 135 during set-up or movement in the terrain, a horizontation device according to FIGS. 20–22 can be utilized. The chassis 135 carries in the middle plane thereof a bearing socket 188 mating with a ball joint 189 at the underside on a forward right angular corner of the base plate 190. On the latter is carried the stand 134 of the drill boom 122, 123 at the forward end of which stand the vertical axle 138 of the boom support 132 is journalled in a bearing plate 191. The base plate 190 is terminated in rearward direction by upstanding plates 192, 193 which in pairs straddle each its power cylinder 194, 195, respectively, and are disposed in mutual perpendicular arrangement. The power cylinder 194 is by means of opposed trunnions 196 pivotally journalled in and between the pair of plates 192 while the power cylinder 195 by means of tunnions 197 in similar way is pivotally journalled in and between its pair of bearing plates 193. The piston rod 198 of the power cylinder 194 is pivotally journaled on a pivot 199 disposed in parallel relation to the trunnions 196 on a link 200 which is pivotally journalled in the chassis 135 by opposite trunnions 201 in perpendicular transverse relation to the pivot 199. In similar way the piston rod 202 of the power cylinder 195 is pivotally journalled to the chassi 135 by two mutually perpendicular pivots, not shown in FIGS. 20, 21.

The task of the power cylinders 194, 195 is to place the base plate 190 in horizontal position without regard to the inclination of the chassis 135 by turning the base plate in two mutually perpendicular planes defined by the centre of the ball joint 189 and the pivots of the piston rods 198, 202 on the chassis 135. This automatic adjustment is attained by two pendulum valves 204, 205 arranged at the corners of the stand 134 with the pendulum valve 205 in perpendicular relation to the vertical plane through the longitudinal axis of the power cylinder 195 and the centre of the ball joint 189 and the pendulum valve 204 in perpendicular relation to the vertical plane through the longitudinal axis of the power cylinder 194 and the centre of the ball joint 189. The pendulum valves 204, 205 are preferably designed in accordance with FIG. 4 each with a pendulum weight 206 which is affixed to the positioning axle 13 of the valve slide 40. The pendulum weights of the valves 204, 205 are preferably disposed within the interior of the stand 134. Thanks to cross pins 207 with respect to which the pendulum weights 206 are able to swing also in the longitudinal direction of the respective valves 204, 205, the pendulum weights 206 may be maintained in the vertical plane without regard to the original inclination of the base plate 190. The pendulum valve 204 is disposed in the previously described feedback position when the portion of the base plate 190 is horizontal which is disposed in the vertical plane between the ball joint 189 and the power cylinder 194. The control conduits O and U of the pendulum valve 204 are connected to the opposite ends of the power cylinder 194 so that the desired levelling feedback coupling is attained. In corresponding way the pendulum valve 205 is connected to the power cylinder 195 for keeping horizontal the portion of the base plate 190 which extends along the vertical plane through the ball joint 189 and the power cylinder 195. With two mutually angularly disposed or perpendicular sides of the base plate 190 levelled, the whole base plate will take the desired horizontal position.

By turning the pendulum valves 204, 205 from the outside by their end flange 44 it will be possible during movement or during working adjustment momentary to give the drill boom 122, 123 an angular change relative to the chassis 135 for example for avoiding obstacles in the terrain. If it is desired to make the boom support 132 generally adjustable in angular relation to the vertical line, a pendulum actuated directional valve 127 of the type shown in FIG. 13 may be applied with a pendulum weight 206 on the positioning axle 13 of that valve. Such remotely controlled angularly positioning pendulum valves can advantageously be applied for vertical or horizontal attitude control of positioning motor actuated machine elements generally such as for example platforms, masts, working bridges, ladders etc.

Figure 25:
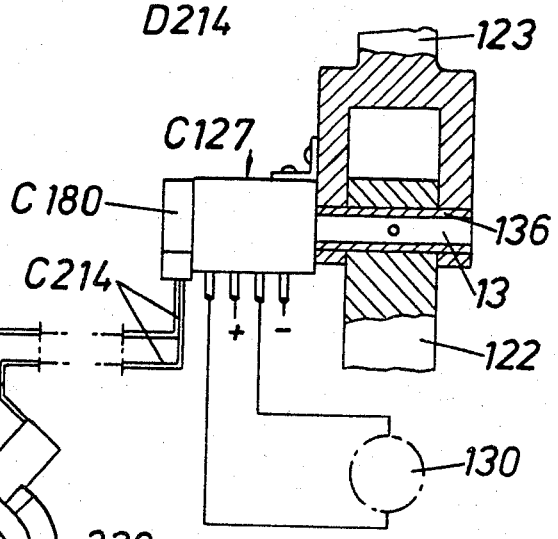
FIG. 25 shows a fragmentary view on the line 25—25 in FIG. 24.
Figure 26:
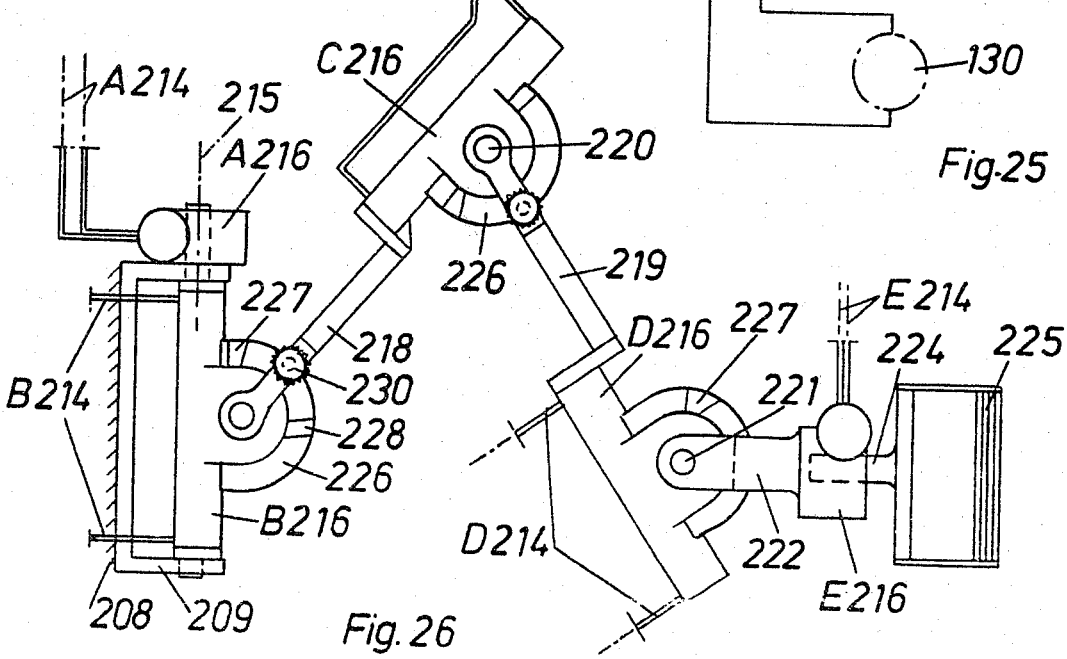
FIG. 26 shows an angle setting lever system pertaining to FIGS. 24, 25.

In the embodiment according to FIG. 24 the drill boom 122, 123 carries a suitable working tool, for example an impact breaker 210 depicted diagrammatically directly on the boom head 120. Similarly to the feed in FIG. 15 the breaker 210 is angularly adjustable by means of the cylinder 125 and tipped together with the boom head 120 by the cylinder 128. All five positioning motors or power cylinders 133, 131, 130, 128 and 125 of the drill boom 122, 123 are associated at their respective turning and articulation axes with a directional valve of the type shown in FIG. 13 and are designated by A 127–E 127. Along the drill boom 122, 123 is suitably extended a main pressure manifold 211 for supplying pressure oil to the directional valve systems and a main return manifold 212 which both in FIG. 24 are shown diagrammatically as straightly extended in the plane of the drawing. All directional valves A 127–E 127 are with their previously described pressure fluid connections on the one hand coupled to the manifolds 211, 212 and on the other to the particular power cylinder which is controlled by the respective directional valve. The control cylinder devices A 180–E 180 of the directional valves, of which for the sake of simplicity only C 180 is shown, FIG. 25, are by means of connecting conduits A 214–E 214 connected each to its own control cylinder device A 216–E 216, each designed similarly to the cylinder device 82 in FIG. 12. In accordance with FIG. 26, in each of the cylinder devices A 216–E 216 an angular positioning lever is included which provides a model pattern for the angular position of the corresponding boom part or working tool respectively. The cylinder device C 216 for example is carried as shown in FIG. 26 by an arm 218 together with which it forms an angular positioning lever for the boom part 122. The cylinder device D 214 is carried in a corresponding way by an arm 219 together with which it forms an angular positioning lever providing the model pattern for the boom part 123 in respect of angular adjustment. When the arm 219 is turned about the axis 220, the valve C 127 will be actuated as described above via the cylinder device C 216, its connecting conduits C 214 and the cylinder device C 180 so that the power cylinder 130 will adjust the boom part 123 with the arm 219 as a model of adjustment. The adjustment levers in FIG. 26 are mounted at a suitable maneuvering panel 208 in which a bracket 209 is affixed. In the latter the cylinder device B 216 is pivotally journalled about a vertical axis 215 so that during turning therearound the cylinder device A 216 will be actuated at which instant the latter via the connection A 214 and the directional valve A 127 by means of the power cylinder 133 causes a turning of the boom support 132 which reproduces the setting of the cylinder device B 216 acting as angle setting lever. The cylinder device B 216 carries at its turning axis 221 an arm 222 which carries a cylinder device E 216 and provides an angle setting lever as a pattern to be reproduced by the angular setting of the boom head 120. During turning of the arm 222 about the axis 221 the boom head 120 namely will turn about its axle as a result of the valve D 127 controlling the power cylinder 128 thereof. The cylinder device E 216 in its turn is actuated by a turning axis 224 which carries a handle 225. Said handle 225 provides an angle setting lever as a pattern to be reproduced by the adjustment of the impact breaker 210 and can simultaneously be used as an actuating means for the whole angle setting lever system pattern in FIG. 26. By turning the handle 225 together with the axle 224 the cylinder device E 216 actuates the directional valve E 127 via the connecting conduit E 214 so that the power cylinder 125 will adjust the machine breaker 210 to the same angular position as the handle 225. The connecting conduits A 214–E 214 are preferably completed by adjusting means of the type described in connection with FIGS. 12 and there designated by the numerals 96, 97 and 98. The cylinder devices B 216, C 216 and D 216 are provided with setting sectors 226 which are straddled by the arms 218, 219 and 222, stopping abutments 227, 228 being arranged on the sectors 226 for limiting the angular movement of the setting arms in proper relation to the boom parts 122, 123 and 120 and their maximum possible angular movement. Set screws 230 can be arranged on the arms 218, 219 for affixing these in suitably desired position.

It will be evident that by turning, lifting and sidewise turning of the handle 225 or the arms 218, 219, 222 it will be possible to exactly dictate the corresponding angle values for the impact breaker 210 and the adjustment of the boom parts 122, 123, 132, 120. The operator thus will be completely relieved from heavy manual handling. It is also evident that instead of the impact breaker 210 it will be possible to use the control system depicted in FIGS. 24–26 for remote control of working tools or machine units of any type.

What I claim is:

1. Directional valve means and boom frame device for positioning machine units, comprising:

(a) a machine unit (18), (b) a support (17), (c) a pivot axis (21) on said support for angularly adjustably supporting said machine unit thereon, (d) a pressure fluid actuated motor (26) between said support and said machine unit for angular adjustment of said machine unit, (e) a hydraulic directional valve (27) for controlling the pressure fluid supply to said motor, said directional valve (27) comprising a first element incorporating valve housing means (41), and a second element incorporating cooperating valve body means (40) which are adjustable relative to said valve housing means, said first and second elements (40,41) having cooperating valve surfaces for controlling said pressure fluid supply, (f) one of said first and second valve elements (40,41) being coupled to pivot conjointly with the machine unit (14,18,10) so as to sense the actual angular position of the machine unit on said support (g) means for adjusting the angular relationship of the other of said valve elements (40) to a selective set angle value for said machine unit, said means including an angle transmission connecting said other element to an angular control position remote from said machine unit, (h) said valve elements (40,41) having a feedback position (FIGS. 5,6) in respect of angular movement produced by said motor means, said feedback position being defined by said cooperating valve surfaces of said valve elements, in which feedback position the pressure fluid supply to the positioning motor (26) is cut down or cut off when said actual angle valve coincides with said predetermined set angle value in said valve, (i) and said directional valve in its feedback position (FIGS. 5,6) adapted to pressurize the positioning motor in the two opposite directions of movement thereof by providing a larger incoming than return leakage through the directional valve to and from said positioning motor.

2. A device according to claim 1 in which in the feed back position (FIG. 5) of the directional valve one (41) of the elements thereof has supply passages (54,55) which in the opposite directions of movement of the other element (40) are adapted to open under a throttling effect to pressure passages (49) in the other element (40), one such supply passage (54,55) being provided for actuating the positioning motor in each of its directions of movement.

3. A device according to claim 2 in which said one element (41) of the directional valve in the feed back position (FIG. 6) thereof has return passages (56,57) for opening under a throttling effect in opposite directions of movement for the other element (40) to low pressure return passages (50) in the other element, one such return passage (56,57) being provided for relieving the positioning motor in each of its directions of movement.

4. A device according to claim 2 or 3 in which said other element (40) of the directional valve forms a valve plug in a valve housing (41) providing in its turn said one element, the throttling being provided by opposed throttling openings (54-57) in the valve housing (41) which in the directions of movement of said valve plug (40) are followed by non-throttled secondary openings (59) in the valve housing.

5. Directional valve means and boom device for positioning machine units by the aid of hydraulic pressure fluid driven positioning motor means (26) and a directional valve (27) in flow connection with said motor means for controlling the pressure fluid supply thereto, in which a machine unit (14,18,10) is to be angularly positioned about at least a first pivot axis (21) relative to an outlying boom frame means (17) which in turn is angularly adjustable at least about a second axis (22) relative to a supporting means (29), the directional valve (27) being included in an angle setting servo system incorporating a control unit which under movement of the boom frame means (17) automatically governs the positioning motor means (26) so as to cause the machine unit (14,18,10) to maintain its actual directional angle value in the surrounding space in relation to a predetermined set angle value therefor;

said directional valve (27) comprising a first element incorporating valve housing means (41), and a second element incorporating cooperating valve body means (40) which are adjustable relative to said valve housing means, said first and second elements (40,41) having cooperating valve surfaces, one of said first and second elements (40,41) having a given angular relationship to the actual angle value of the machine unit (14,18,10), and the other of said first and second elements (40,41) having a given angular relationship to said predetermined set angle value therefor;

said directional valve (27) in itself forming said control unit in that its elements (40,41) have a feedback position (FIGS. 5, 6) defined by said cooperating valve surfaces thereof, in which feedback position the pressure fluid supply to the positioning motor (26) is cut down or cut off by said surfaces when said actual angle value coincides with said predetermined set angle value;

further comprising an angle transmission including an angle setting lever (70) for providing said given angular relationships, said angle transmission transmitting an angle value to the directional valve (27) to or from a fixed position in the surrounding space remote from said machine unit (14,18,10), said angle setting lever (70) being mounted to provide a setting pattern to be reproduced by the angular attitude of the machine unit;

said machine unit being pivotable about three mutually perpendicular pivot axes (126,13,138) which define a Cartesian coordinate system, said boom frame means (122,123) at the supporting means (132) thereof being mounted pivotably about two mutually perpendicular axes (28,138), and said angle setting lever (70) being mounted to be settable in a selective angular position about three mutually perpendicular axes (176,177,138) which are each parallel or coincide with a respective one of said pivot axes (126,28,138) of said machine unit (18,10) for reproduced three dimensional directioning of the machine unit (18);

and further comprising slight means (157-160) associated with said angle positioning lever (70), said angle positioning lever (70) being maintainable in selective position by said sight means (157,160) for defining the desired bearing and direction angles of the machine unit relation to the surrounding terrain.

6. A device according to claim 5, in which said supporting means (132) is pivotally journalled on a chassis (135) and further comprising pendulum actuated directional valve means (204,205) in servo feedback relation to pressure fluid cylinders (194,195) associated therewith for automatic levelling or selective angular positioning of said supporting means (132) with respect to the vertical.

7. Directional valve means and boom frame device for positioning machine units, comprising:

(a) a machine unit, (b) an elongated boom (17), (c) a first pivot axis (21) on said boom for angularly adjustably supporting said machine unit on said boom, (d) a pressure fluid actuated first motor means (26) between said boom and said machine unit for angular adjustment of said machine unit, (e) a supporting means, (f) a second pivot axis (22) on said supporting means and parallel with said first axis for angularly adjustably supporting said boom on said supporting means, (g) second motor means on said supporting means for angularly positioning said boom relative thereto, (h) a first directional valve (27) at the outer end of said boom for controlling the pressure fluid supply to said first motor, and first directional valve (27) comprising a first element incorporating valve housing means (41), and a second element incorporating cooperating valve body means (40) which are adjustable relative to said valve housing means, said first and second elements (40,41) having cooperating valve surfaces for controlling said pressure fluid supply, (i) one of said first and second valve elements (40,41) having a given angular relationship to the actual angular position of the machine unit (14,18,10) on said boom, (j) means for maintaining a constant angular relationship of the other of said valve elements (40) in respect to a predetermined set angle value therefor during angular adjustment of said boom (18) by said second motor means, said maintaining means including an angle transmission connecting via said pivot axes (20,21) said other element to an angular position associated with said supporting means.

(k) said valve elements (40,41) having a feedback position (FIGS. 5,6) in respect of angular movement produced by said first motor means, said feedback position being defined by said cooperating valve surfaces of said valve elements, in which feedback position the pressure fluid supply to the positioning motor (26) is cut down or cut off when said actual angle value coincides with said predetermined set angle value in said valve, (l) means for angularly selectively adjusting said angle transmission such that said given angular relationship associating said other element with said supporting means may be varied so as to provide full angular adjustment of said machine unit, and (m) a second directional valve associated with said supporting means for controlling the pressure fluid supply to said second motor at will so as to provide selective angular adjustment of said boom with said other valve element remaining in said constant angular relationship.

8. A device according to claim 7, in which said adjusting means for angularly selectively adjusting the given angle relationship of one of said valve elements is an angle setting lever angularly adjustable relative to said supporting means and connected via said angle transmission to said other element both for maintaining and for selective positioning of said set angle value thereof.

9. A device according to claim 7, in which said angle transmission comprises one or more parallelogram linkages (68,66,64) having said pivot axes (21,22) as their axes of reference.

10. A device according to claim 7, in which said angle transmission comprises hydraulic cylinder means (80,81,82) interassociated for providing hydraulic transmission of parallel movement and having said pivot axes (21,22) as their axes of reference.

11. A device according to claim 7, in which said one element (41,102) of the directional valve is journalled angularly adjustable relative to the machine unit in a bearing (100) and is coupled to an angle setting lever (70).

12. A device according to claim 11, in which said bearing (100) comprises a collector means (102) between said bearing and the valve elements for allowing angularly independent passage of pressure fluid to and from said elements (40,41) of said directional valve.

* * * * *